US008021499B2

(12) United States Patent
Ishida et al.

(10) Patent No.: US 8,021,499 B2
(45) Date of Patent: Sep. 20, 2011

(54) FUNCTIONAL MEMBER FROM CO-BASED ALLOY AND PROCESS FOR PRODUCING THE SAME

(75) Inventors: Kiyohito Ishida, Sendai (JP); Kiyoshi Yamauchi, Sendai (JP); Ryosuke Kainuma, Natori (JP); Yuji Sutou, Sendai (JP); Toshihiro Omori, Sendai (JP)

(73) Assignee: Japan Science and Technology Agency, Saitama (JP)

( * ) Notice: Subject to any disclaimer, the term of this patent is extended or adjusted under 35 U.S.C. 154(b) by 777 days.

(21) Appl. No.: 12/098,771

(22) Filed: Apr. 7, 2008

(65) Prior Publication Data

US 2011/0041966 A1 Feb. 24, 2011

Related U.S. Application Data

(63) Continuation of application No. PCT/JP2006/320689, filed on Oct. 11, 2006.

(30) Foreign Application Priority Data

Oct. 11, 2005 (JP) ..... 2005-296848

(51) Int. Cl.
*C22C 19/07* (2006.01)

(52) U.S. Cl. ..... 148/425; 420/435

(58) Field of Classification Search ..... 148/418, 148/425, 674; 420/435–440, 580, 585, 586
See application file for complete search history.

(56) References Cited

U.S. PATENT DOCUMENTS

| | | | |
|---|---|---|---|
| 4,491,561 A | 1/1985 | Mann | |
| 4,606,887 A | 8/1986 | Hausselt et al. | |

FOREIGN PATENT DOCUMENTS

| | | | |
|---|---|---|---|
| JP | 3-130322 A | | 6/1991 |
| JP | 5-25568 A | | 2/1993 |
| JP | 6-264195 A | | 9/1994 |
| JP | 7-110592 A | | 4/1995 |
| JP | 7-331370 A | | 12/1995 |
| JP | 10-140279 A | | 5/1998 |
| JP | 2002-129273 | * | 5/2002 |
| JP | 2002-129273 A | | 5/2002 |
| JP | 2004-238720 | * | 8/2004 |
| JP | 2004-277865 | * | 10/2004 |

OTHER PUBLICATIONS

ASM Specialty Handbook: Nickel, Cobalt, and Their Alloys, copyright 2000, 3 pages total.*

International Search Report of PCT/JP2006/320689, date of mailing Nov. 21, 2006.

* cited by examiner

*Primary Examiner* — George Wyszomierski

*Assistant Examiner* — Mark L Shevin

(74) *Attorney, Agent, or Firm* — Westerman, Hattori, Daniels & Adrian, LLP

(57) ABSTRACT

A Co-based alloy having a fundamental composition of Co—Al system containing 3-15% Al and having lamellar structure wherein f.c.c. structure α-phase and β(B2)-phase are superimposed on each other in layers, and the Co-based alloy is modified so as to have a porous surface layer region effective for chemical retaining capability, sustained release, biocompatibility, etc. through selective removal of either the α-phase or the β-phase from the surface layer. As a third component, at least one member selected from among Ni, Fe, Mn, Ga, Cr, V, Ti, Mo, Nb, Zr, W, Ta, Hf, Si, Rh, Pd, Ir, Pt, Au, B, C and P may be contained in a total amount of 0.001 to 60%.

3 Claims, 2 Drawing Sheets

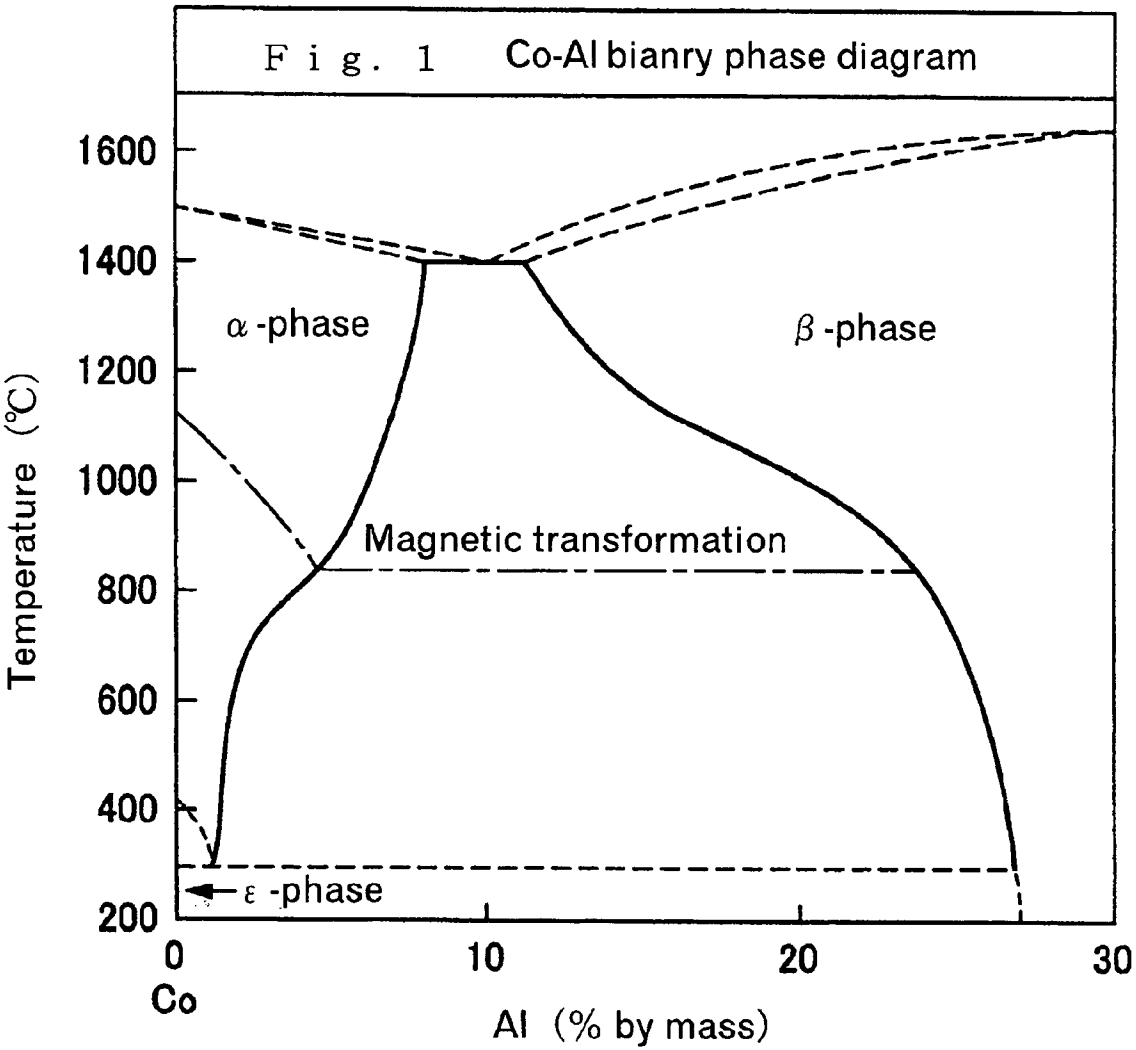
Fig. 1 Co-Al bianry phase diagram

Fig. 2 Surface structure of Co-based alloy containing 6.9%Al
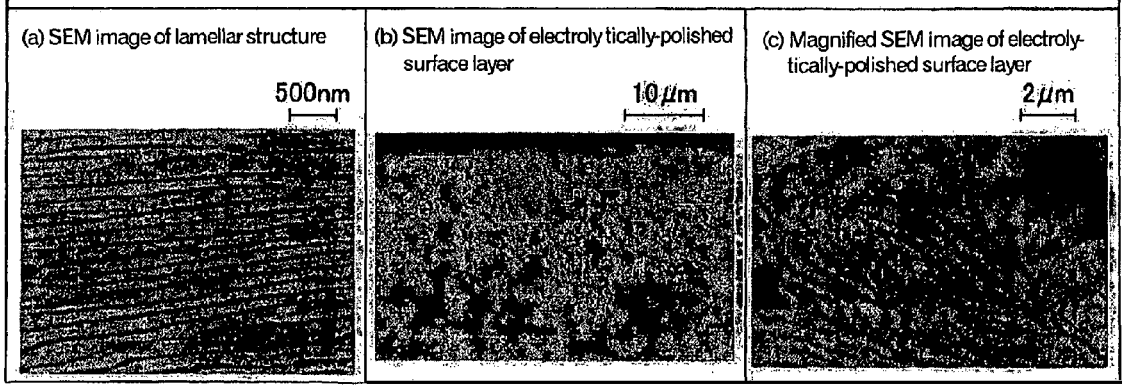

FUNCTIONAL MEMBER FROM CO-BASED ALLOY AND PROCESS FOR PRODUCING THE SAME

TECHNICAL FIELD

The present invention relates to a functional member from Co-based alloy having a porous surface layer which can impart various functions and process for producing thereof.

BACKGROUND ART

Since a cobalt-base alloy has excellent corrosion resistance and mechanical strength, it is used for a wide range of applications such as medical instruments, biomechanical materials, and wear-resistant materials. Cr, Ni, Fe, Mo, C, etc. are added in order to further improve characteristics, for example, corrosion resistance, oxidation resistance, stabilization of α-phase, and material strengthening. Various strengthening methods such as solid solution strengthening, precipitation strengthening, and work hardening methods have been proposed.

The conventional strengthening methods are based on a metallic structure in which an α-single phase or a second phase is continuously precipitated in the α-phase (Patent documents 1 and 2). Although higher strength properties are given to the Co-based alloy by precipitation of the second phase, higher strength properties have been needed in accordance with a strong demand related to use conditions, or thinner wire and miniaturization.

The strengthening method by the lamellar structure is also used for other alloy systems and a typical example thereof is a pearlite transformation which is observed in ferrous materials. When the lamellar structure of ferrite and cementite is formed by pearlite transformation, ferrous materials are highly strengthened.

As a method for strengthening the quality of materials using the lamellar structure, Cu—Mn—Al—Ni alloy having the lamellar structure disclosed in Patent document 3 is introduced by the present inventors and Co—Al binary alloy having the lamellar structure is also reported in Nonpatent document 4. Since the Co—Al alloy has the lamellar structure in which a soft α-phase and a hard β-phase are repeated and their gaps are quite small, it is used as a material of equipment capable of maintaining necessary strength even when it is made to be a thinner wire or miniaturized.

Patent Document 1: JP 7 (1995)-179967A
Patent Document 2: JP 10 (1998)-140279A
Patent Document 3: JP 5 (1993)-25568A
Nonpatent Document 4: P. Zieba, Acta mater. Vol. 46. No. 1 (1998) pp. 369-377

DISCLOSURE OF THE INVENTION

The present inventors examined various methods for improving the functionality while utilizing excellent characteristics of Co-based alloy having a lamellar structure. As a result, it is found out that when either the α-phase or the β-phase having a lamellar structure is selectively removed, the surface layer region of Co-based alloy becomes porous.

An objective of the present invention is to provide a functional member from Co-based alloy which is modified so as to have a porous surface layer capable of imparting various functions by selectively removing the α-phase or the β-phase from the lamellar structure on the surface of Co-based alloy on the basis of the findings.

The functional member from Co-based alloy of the present invention includes a base member containing 3 to 15% by mass of Al and having a lamellar structure in which a f.c.c. structure α-phase and β-phase are repeatedly superimposed in layers and the surface of the base member is modified so as to have a porous structure by selectively removing the α-phase or the β-phase. Hereinafter, the content of an alloy component is simply expressed as % and other rates are expressed as % by volume and % by area.

The Co—Al binary alloy is precipitated as a lamellar structure in which the f.c.c. structure α-phase and β(B2)-phase are superimposed on each other in layers during the solidification process or the aging treatment after solution treatment. A Co—Al binary system is a fundamental composition and a third component may be added if necessary.

At least one member selected from Table 1 is used as the third component. As for the third component, one or more members are added in a total amount of 0.001 to 60%. Table 1 shows the third component that can be added and the relationship between the additive amount and the precipitate.

TABLE 1

Additive amount depending on the type of the third component Main precipitates formed

| Element name | Additive amount(%) | Main precipitates |
|---|---|---|
| Ni | 0.01-50 | B2 |
| Mn | 0.01-30 | B2 |
| Mo | 0.01-30 | B2, $D0_{19}$ |
| W | 0.01-30 | B2, $L1_2$, $D0_{19}$ |
| Ta | 0.01-15 | B2 |
| Ga | 0.01-20 | B2 |
| Ti | 0.01-12 | B2, $L1_2$ |
| C | 0.001-3 | B2, $M_{23}C_6$, $E2_1$ |
| Pd | 0.01-20 | B2 |
| Pt | 0.01-20 | B2 |
| B | 0.001-1 | B2 |
| Fe | 0.01-40 | B2 |
| Cr | 0.01-40 | B2, $M_{23}C_6$ |
| Si | 0.01-5 | B2, C23 |
| Zr | 0.01-10 | B2 |
| Hf | 0.01-10 | B2 |
| V | 0.01-20 | B2, Co3V |
| Nb | 0.01-20 | B2, C36 |
| Rh | 0.01-20 | B2 |
| Ir | 0.01-20 | B2 |
| Au | 0.01-10 | B2 |
| P | 0.001-1 | B2 |

B2: $C_sCl$ type β-phase
$E2_1$: $CaO_3Ti$ type
$D0_{19}$: $Ni_3Sn$ type
C23: $Co_2Si$ type
$L1_3$: $AuCu_3$ type γ' phase
C36: $MgNi_2$ type In the system to which the third component is added, a $L1_2$-type γ' phase, a $D0_{19}$-type precipitate, and a $M_{23}C_6$-type carbide are formed in the α-phase to have a lamellar structure. When the $L1_2$-type γ' phase, $D0_{19}$-type precipitate, and $M_{23}C_6$-type carbide are left after selective removal of the $L1_2$-type γ' phase, $D0_{19}$-type precipitate, and $M_{23}C_6$-type carbide or, conversely, selective removal of the α-phase, a porous structure from the lamellar structure is formed on the surface of Co-based alloy. Hereinafter, the $L1_2$-type γ' phase, $D0_{19}$-type precipitate, and $M_{23}C_6$-type carbide will be described by representing the β-phase as needed.

The lamellar structure is formed in the process of solidifying the Co-based alloy which is prepared so as to have a predetermined composition and dissolved. In addition to the cooling method of the Co-based alloy injected into a normal mold, the unidirectional solidification or the solidifying method using an apparatus for crystal growth from melt such as a Bridgman furnace can also be employed. The Co-based alloy is subjected to solution treatment at 900 to 1400° C., followed by aging treatment at 500 to 900° C. and the lamellar structure in which the f.c.c. structure α-phase and β(B2)-phase are repeated in layers is obtained.

When the α-phase or the β-phase is selectively removed from the Co-based alloy having a lamellar structure, the surface layer of the Co-based alloy is modified so as to have a porous structure in which a cell skeleton is formed on the remaining phase. Physical polishing, chemical polishing, and electrochemical polishing, either alone or in combination, are used for selective removal of the α-phase or the β-phase. When various substances are impregnated, adsorbed, or bonded onto the surface layer of Co-based alloy with a porous structure, the characteristics depending on the substances are imparted.

BRIEF DESCRIPTION OF THE DRAWINGS

FIG. 1 is a Co—Al binary phase diagram in order to describe the formation mechanism of the lamellar structure.

FIG. 2 is a SEM image showing the lamellar structure formed by Co—Al binary alloy became porous by electrolytic polishing.

BEST MODE FOR CARRYING OUT THE INVENTION

Various elements were mixed with Co to form the lamellar structure similar to a pearlite structure in steel and the relation between the added elements and the structure was examined. As a result, it is found that alloy components with a high solid solubility limit in a high-temperature region and a low solid solubility limit in a low temperature region so as to form a discontinuous precipitate are effective in forming the lamellar structure, among them, Al is an effective element for the lamellar structure. Specifically, when the Co—Al binary alloy containing a proper amount of Al is subjected to controlled cooling or aging treatment in a process of cooling and solidifying, the lamellar structure with the f.c.c. structure α-phase matrix and β (B2)-phase is formed.

The α-phase has a face-centered cubic (f.c.c.) crystal structure. As shown in the Co—Al binary phase diagram, the α-phase is a phase in which Al is dissolved in Co and may be transformed to the martensitic phase of h.c.p. structure at low temperature. In the Co—Al binary system, the β-phase is in equilibrium with the α-phase and has a B2 type crystal structure. On the other hand, in the system to which a proper amount of the third component is added, the $L1_2$-type γ' phase, $D0_{19}$-type precipitate, $M_{23}C_6$-type carbide, and the like were also precipitated. Various precipitates can be identified by X-ray diffraction, TEM observation, or the like.

The lamellar structure is a diplophase structure in which an α-phase and a crystallized phase or precipitated phase are superimposed on each other in layers. Better toughness is observed as an interlayer spacing (lamellar spacing) of the α-phase and the crystallized phase or precipitated phase is significantly smaller.

The lamellar structure is formed by discontinuous precipitation represented by α'→α+β. Although an α'-phase is the same as the α-phase, there is a concentration gap at the interface of the α'-phase and the concentration of dissolved substance of the mother phase does not change. In the Co—Al binary system of FIG. 1, when heat treatment is performed in the α-single phase region and then in a predetermined α+β two-phase region, discontinuous precipitation occurs. In most cases of discontinuous precipitation, the two-phase becomes a group referred to as a colony in a crystal grain boundary as a base point and grow and the lamellar structure in which the α-phase and β-phase are repeatedly superimposed on each other in layers is formed.

There are various theories on the formation mechanism of the lamellar structure.

The examples are as follows:

Precipitates which are precipitated in the grain boundary are not matched to the grain boundary and further they are matched or semi-matched to the mother phase, therefore, the grain boundary moves in the direction of an interface between the precipitate and the grain boundary due to the energy imbalance and the lamellar structure is formed by repetition of the grain boundary migration; and When the grain boundary migration occurs, precipitates are formed in the grain boundary during the process, and when further grain boundary migration occurs, they become the lamellar structure.

Various factors such as the surface energy of the mother phase and the precipitated phase, the strain energy, and differences in melting point and temperature are associated with reaction of the lamellar structure, which complicates elucidation of the formation mechanism. In any case, it is grain boundary reaction type precipitation. When premised on a general rule where lattice diffusion becomes predominant in a high temperature region and grain boundary diffusion becomes predominant in a low temperature region upon reaching about 0.75 to 0.8 Tm (Tm: absolute temperature of melting point), it can be said that a heat treatment at a relatively low temperature is necessary to form the lamellar structure resulted from the grain boundary reaction. However, when the driving force of precipitation (in other words, degree of undercooling in a single phase region) is small, the precipitation reaction becomes slow. Therefore, the degree of undercooling needs to be increased to a certain level.

The Co—Al binary condition diagram (FIG. 1) shows that the solid solubility of the α-phase is greatly reduced at the magnetic transformation temperature or less. In the Co—Al binary alloy, the solid solubility of the α-phase is significantly changed upon reaching the magnetic transformation temperature and the difference of the solid solubility becomes great in the high and low temperature regions, which causes the increase of the driving force of precipitation. As a result, the lamellar structure can be sufficiently formed by heat treatment at low temperature.

It is known that the lamellar structure is also formed by eutectic reaction. The eutectic reaction is represented by L→α+β. In the Co—Al binary system (see FIG. 1), the eutectic reaction occurs when an alloy containing about 10% of Al is solidified. In the eutectic reaction, the α-phase and the β-phase are crystallized at the same time. Then, solute atoms are diffused throughout the solidified surface and two phases adjacent to each other grow at the same time. Thus, the lamellar structure or a bar structure is formed. The lamellar structure is formed when the volume fraction of both phases is almost equal. When there is a large difference in the volume fraction, the bar structure tends to be formed.

In the case of the Co—Al alloy having an eutectic composition, the lamellar structure is formed because there is no large difference in the volume fraction of the α-phase and the β-phase in a high temperature region in which the metallic structure is formed.

The lamellar structure is not formed by eutectoid reaction and continuous precipitation in the case of the Co—Al binary alloy, while it is formed in the case of the system which contains the third component. The lamellar structure is not obtained by normal continuous precipitation, while the lamellar structure is easily formed when the intended precipitation reaction proceeds.

The lamellar structure has a periodic repetition of the α-phase and the β-phase. The lamellar structure formed during the solidification process results from eutectic reaction and the lamellar structure formed by the aging treatment results from discontinuous precipitation and eutectoid transformation. Even if the continuous precipitation is performed, the lamellar structure is easily formed by facilitating the intended precipitation reaction.

The Co-based alloy having the lamellar structure with an interlayer spacing of 1 μm or less has a high mechanical strength and the rate of increase of the surface area is observed after the formation of the porous structure. Although the mechanical strength is slightly reduced when the interlayer spacing is in the range of 1 to 100 μm, a pore with a size sufficient to permit a substance to enter is formed in the surface region by treatment for the formation of the porous structure. The interlayer spacing which controls the pore size can be controlled by cooling conditions during the solidification process, aging treatment conditions, and the like. The pore size fundamentally depends on the interlayer spacing of the lamellar structure, it can be adjusted in the range of 10 nm to 100 μm depending on the lamellar structure. Alternatively, the interlayer spacing of the lamellar structure is narrowed by cold-rolling the Co-based alloy after the formation of the lamellar structure, and further the porous surface layer region with a small pore size can be formed.

When the Co-based alloy having the lamellar structure is subjected to physical polishing, chemical polishing or electrochemical polishing and either the α-phase or the β-phase is selectively removed, the porous layer which maintains the skeleton of the lamellar structure is formed in the surface layer. With reference to the selective removal of the α-phase or the β-phase, physical differences in both phases are used. The α-phase, which is relatively soft and chemically noble, tends to be removed by physical means, while the β-phase, which is relatively hard and chemically basic, tends to be removed by chemical or electrochemical technique.

The surface area of the porous surface layer region formed by selective removal of the α-phase or the β-phase is significantly larger than that of the surface of the original base member. The α-phase or the β-phase which is remained after the polishing has a three-dimensionally complicated micropore. Such a specific porous structure permits drugs, body tissues, lubricants, and the like to enter the surface of the material and imparts functions such as retention of substance, sustained-release, strong coupling, biocompatibility, heat dissipation, and catalytic activity to the Co-based alloy.

The Co-based alloy being used as a base member has a fundamental composition of Co—Al binary system containing 3 to 15% of Al. Al is a component essential for the formation of crystallized phase or precipitated phase and addition of 3% or more Al ensures the formation of the β (B2)-phase to be intended. However, when the content of Al exceeds 15%, a matrix becomes the β-phase, the proportion of the lamellar structure having a periodic repetition of the α-phase and the β-phase is significantly reduced. Preferably, the Al content is selected in the range of 4 to 10%.

Ni, Fe, and Mn are components effective in stabilizing the α-phase and contribute to the improvement of ductility. However, the addition of an excessive amount thereof has a deleterious effect on the formation of the lamellar structure. When Ni, Fe, and Mn are added, the Ni content is selected in the range of 0.01 to 50% (preferably 5 to 40%), the Fe content is selected in the range of 0.01 to 40% (preferably 2 to 30%), and the Mn content is selected in the range of 0.01 to 30% (preferably 2 to 20%).

Cr, Mo, and Si are components effective in improving the corrosion resistance, however, the addition of an excessive amount thereof leads to a significant deterioration in ductility. When Cr, Mo, and Si are added, the Cr content is selected in the range of 0.01 to 40% (preferably 5 to 30%), the Mo content is selected in the range of 0.01 to 30% (preferably 1 to 20%), and the Si content is selected in the range of 0.01 to 5% (preferably 1 to 3%).

W, Zr, Ta, and Hf are components effective in improving the strength, however, the addition of an excessive amount thereof leads to a significant deterioration in ductility. When W, Zr, Ta, and Hf are added, the W content is selected in the range of 0.01 to 30% (preferably 1 to 20%), the Zr content is selected in the range of 0.01 to 10% (preferably 0.1 to 2%), the Ta content is selected in the range of 0.01 to 15% (preferably 0.1 to 10%), and the Hf content is selected in the range of 0.01 to 10% (preferably 0.1 to 2%).

Although Ga, V, Ti, Nb, and C have effects to facilitate the formation of precipitates and crystallized products, the proportion of lamellar structure to total metallic structure tends to be decreased when an excessive amount of them is added. When Ga, V, Ti, Nb, and C are added, the Ga content is selected in the range of 0.01 to 20% (preferably 5 to 15%), the V content is selected in the range of 0.01 to 20% (preferably 0.1 to 15%), the Ti content is selected in the range of 0.01 to 12% (preferably 0.1 to 10%), the Nb content is selected in the range of 0.01 to 20% (preferably 0.1 to 7%), and the C content is selected in the range of 0.001 to 3% (preferably 0.05 to 2%).

Although Rh, Pd, Ir, Pt, and Au are components effective in improving X-ray contrast property, corrosion resistance, and oxidation resistance, the formation of the lamellar structure tends to be inhibited when an excessive amount of them is added. When Rh, Pd, Ir, Pt, and Au are added, the Rh content is selected in the range of 0.01 to 20% (preferably 1 to 15%), the Pd content is selected in the range of 0.01 to 20% (preferably 1 to 15%), the Ir content is selected in the range of 0.01 to 20% (preferably 1 to 15%), the Pt content is selected in the range of 0.01 to 20% (preferably 1 to 15%), and the Au content is selected in the range of 0.01 to 10% (preferably 1 to 5%).

B is a component effective for grain refinement, however, an excessive content of B causes a significant deterioration in ductility. When B is added, the B content is selected from the range of 0.001 to 1% (preferably 0.005 to 0.1%).

Although P is a component effective for deoxidation, however, an excessive content of P causes a significant deterioration in ductility. When P is added, the P content is selected from the range of 0.001 to 1% (preferably 0.01 to 0.5%).

In the case where the Co-based alloy adjusted to a predetermined composition is dissolved, followed by casting and cooling, the f.c.c. structure α-phase and β (B2)-phase are crystallized while forming the lamellar structure during solidification. The lamellar spacing is proportional to $v^{-1/2}$ when the growth rate is defined as v. Therefore, the growth rate can be controlled by the growth rate v and further the lamellar spacing can be controlled. Specifically, the growth rate v is larger as the cooling rate is faster, which results in a smaller lamellar spacing. When the cooling rate is slow, the crystal growth proceeds and the interlayer spacing becomes large. Fully satisfied characteristic can be obtained even when casting materials are used. The characteristic can be improved by performing hot working, cold working, and strain removing annealing. The casting materials are casted and hot-rolled if necessary, and then subjected to cold working, drawing so as to be formed into a plate member, a wire member and a pipe member etc., with a target size.

In any case, characteristics such as high strength and toughness derived from the lamellar structure are given by setting the proportion of the lamellar structure to 30% or more by volume of the total metallic structure.

In the case where the lamellar structure is formed by either controlled cooling in the solidification process or aging treatment, the adjustment of the phase spacing between the f.c.c. structure α-phase and β (B2)-phase to 100 μm or less is effective in utilizing the characteristics resulting from the lamellar structure. When the phase spacing is greater than 100 μm, the characteristics of the lamellar structure and further the characteristics of the surface layer region with the porous structure cannot be sufficiently exerted. In the case where the lamellar structure is formed in solidification process, the α-phase and β(B2)-phase are crystallized while forming the lamellar structure in which the both phases of f.c.c. structure are superimposed on each other by casting and solidifying the dissolved Co-based alloy. It is preferable that solidification and cooling are performed with an average cooling rate: 500° C./min or less, preferably 10 to 450° C./min in the range of 1500 to 600° C. to form a stable lamellar structure. Fully satisfied characteristic can also be obtained even when casting materials are used. The characteristic improvement is contemplated by performing hot working, cold working, and strain removing annealing after casting.

In the case of forming the lamellar structure by heat treatment, the process of the solution treatment and aging treatment is carried out.

When the Co-based alloy after the cold working is subjected to solution treatment at 900 to 1400° C., the strain introduced until the cold working process is removed. As a result, precipitates are dissolved in the matrix and the quality of materials is uniformed. It is necessary to set the solution temperature to sufficiently higher than the recrystallization temperature, and thus it is selected in the range of 900° C. or more and 1400° C. (melting point) or less (preferably, 1000 to 1300° C.).

When the aging treatment is carried out at 500 to 900° C. after the solution treatment, the lamellar structure in which the β (B2)-phase is precipitated on the f.c.c. structure α-phase matrix in layers is formed. In order to facilitate the layer precipitation, the aging temperature is set to 500° C. or more to generate a sufficient diffusion. When the heating temperature exceeds 900° C., the lattice diffusion where atom j umps and diffuses while occupying a crystal lattice surface area or an interstitial lattice site becomes predominant. Thus, precipitates with a different from layer precipitates that are formed by grain boundary reaction are easily formed. For that reason, the aging temperature is selected in the range of 500 to 900° C. (preferably 550 to 750° C.). Cold working may be performed in order to facilitate the formation of the lamellar structure prior to the aging treatment. In general, when the aging temperature is lowered, the interlayer spacing becomes smaller and the volume fraction of β(B2)-phase and other precipitates is increased. The reduction of the aging time allows the interlayer spacing to be smaller.

Further, when the Co-based alloy with the lamellar structure is subjected to cold working, the lamellar structure is extended in the working direction. Thus, the formation of a fine-grained structure and work hardening further proceed and high strength is given. Examples of the cold working effective in improving the strength include rolling, wire drawing, and swaging etc. When the working ratio is 10% or more, the effect of cold working is observed. However, an excessive working ratio makes the burdens involved in the processing plant greater. Thus, the upper limit of the working ratio is determined depending on the capability of the processing plant.

In either controlled cooling during casting or aging treatment, characteristics such as high strength and toughness derived from the lamellar structure are given by controlling heating conditions and setting the proportion of the lamellar structure to 30% by volume or more of the total metallic structure. Further, when the phase spacing between the f.c.c. structure α-phase and β (B2)-phase is 100 μm or less, the characteristics resulting from the lamellar structure can be effectively used.

The interlayer spacing becomes relatively large in the case of the formation of the lamellar structure by solidification cooling, while the lamellar structure in which the α-phase and β (B2)-phase with a smaller interlayer spacing are repeated in layers is formed in the case of the formation of the lamellar structure by aging treatment. Thus, when the formation of the lamellar structure by solidification and cooling is combined with the formation of the lamellar structure by aging treatment, it is also possible to form complex tissue having a coarse lamellar structure and a fine lamellar structure.

The Co-based alloy having the lamellar structure is excellent in mechanical property and can be used for various applications. In the present invention, the surface layer region is modified so as to have a porous structure by selectively removing either the α-phase or the β-phase which include the lamellar structure. The porous surface layer region maintains the skeleton of the lamellar structure and the trace of the α-phase or the β-phase selectively removed becomes a micropore. The pore size is determined corresponding to the lamellar structure. Therefore, it is preferable that the precipitation state or the interlayer spacing of the β (B2)-phase is controlled by solidification and cooling conditions or heat treatment conditions in order to obtain the pore size corresponding to the application to the functional member from co-based alloy.

In chemical polishing or electrolytic polishing, usable examples of the polishing solution include a drug solution, a drug solution mixture, and an aqueous solution selected from the group consisting of hydrochloric acid, nitric acid, phosphoric acid, lactic acid, fluoric acid, acetic acid, perchloric acid, ammonia, iron (III) chloride, copper (II) chloride, copper sulfide, chromium (VI) oxide, diammonium tetrachloro caprate (II), potassium disulfide, ammonium hydrogen difluoride, glycerol, hydrogen peroxide, oxalic acid, methanol, and ethanol.

In chemical polishing, either the α-phase or the β-phase is selectively removed by immersing the Co-based alloy having the lamellar structure in a polishing solution. Although the polish temperature and the polish time are not particularly limited, the polish condition is selected so that the surface layer region with a depth of 500 nm or more below the surface of the base member becomes porous.

In electrochemical polishing, either the α-phase or the β-phase is selectively removed by an electrochemical reaction caused by immersing the Co-based alloy having the lamellar structure as an anode in a polishing solution. Materials excellent in the corrosion resistance such as stainless steel and platinum are used for a cathode. Although the electrolytic condition is not particularly restricted, it is preferable to set the voltage, electric current, polish temperature, polish time, and the like so that the surface layer region with a depth of 500 nm or more below the surface of the base member becomes porous.

In physical polishing, either the α-phase or the β-phase is selectively removed by using the hardness difference between both phases. Specific usable examples include ion milling which applies argon ion beams, focused ion-beam irradiation using gallium ion beams, and blast.

TABLE 2

Effective treatment conditions for selective removal of the α-phase or the β(B2)-phase

| | Polishing means | Treating solution | Treatment condition |
|---|---|---|---|
| β-phase | Chemical polishing | $HCl—HNO_3$ mixed-acid bath | Immersion at 25° C. for 30 minutes |
| | | Hydrochloric acid bath | Immersion at 25° C. for 30 minutes |
| | | $FeCl_3$—HCl hydrochloric acid bath | Immersion at 25° C. for 30 minutes |
| | | $EtOH—HNO_3$ mixed-acid bath | Immersion at 25° C. for 30 minutes |
| | Electrolytic polishing | $FeCl_3$—HCl hydrochloric acid bath | Anodic electrolysis for 15 minutes Current density: 10 to 60 $A/dm^2$ |
| | | Hydrochloric acid bath | Anodic electrolysis for 15 minutes Current density: 10 to 60 $A/dm^2$ |
| | | $EtOH—HNO_3$ mixed-acid bath | Anodic electrolysis for 15 minutes Current density: 10 to 60 $A/dm^2$ |
| α-phase | Physical polishing | Ion milling | Ar gas, 3 to 5 keV 30 μA |
| | | Converging ion beam irradiation | Gallium ion beam, 30 kV 10 nA |
| | | Air blast | Alumina |

With reference to selective removal of the $L1_2$-type γ' phase, $D0_{19}$-type precipitate, and $M_{23}C_6$-type carbide produced by the addition of the third component, when the precipitated phase is chemically basic compared to the α-phase, the precipitated phase can be selectively removed by chemical polishing or electrochemical polishing. When the precipitated phase is chemically noble, the α-phase can be selectively removed by chemical polishing or electrochemical polishing. Further, in the case where the precipitated phase is softer than the α-phase, the precipitated phase can be selectively removed by physical polishing. In the case where the precipitated phase is harder than the α-phase, the α-phase can be selectively removed by physical polishing.

It is preferable that porous formation of the surface layer region with a depth of 500 nm or more below the surface of the base member is performed for purpose of effectively using the function of the porous surface layer region. The depth of the porous surface layer region can be adjusted depending on the type of treating solution being used, the concentration, and the processing time. When the depth does not reach 500 nm, a sufficient effect is not obtained by the formation of the porous structure. Even if the depth is deeper, the effect corresponding to the polishing load is not obtained. Thus, it is preferable that the maximum depth of the porous surface layer region is set to about 800 μm.

The trace obtained by selective removal of the α-phase or the β-phase becomes a micropore and the size of micropore is 100 μm or less, reflecting the interlayer spacing of the lamellar structure. The size is suitable for the retention of substance, sustained release, and biocompatibility. Needless to say, when the lamellar structure is fine-grained by solidification cooling conditions during casting, aging treatment conditions, and production history from the solidification to the aging treatment, the micropore also becomes smaller in response to that. The cold working after the aging treatment is also a means effective in allowing the lamellar structure to form a fine-grained structure.

In addition, the porous surface layer region is predominant in the Co-based alloy of the lamellar structure, and thus characteristics of the Co-based alloy in itself, such as high strength, wear resistance, and heat resistance are also utilized. It can be expected to put into wide application, for example, various machineries and instruments, medical instruments and industrial tools, catalyst carriers, and high-performance materials, coupled with the fact that the surface layer is modified to have the porous structure which can impart various functions.

For example, in a drug-eluting stent which has recently begun to be used in the medical field, cell growth of affected areas and restenosis are prevented by the processes of applying drugs to the stent, leaving in affected areas, and continuing dissolution of drugs for a certain period. In the conventional drug-eluting stents, the drug diffusion is controlled by placing polymer particles containing drugs on the stent, and further coating the surface of the stent with polymer particles. However, there is concern about side effects such as inflammatory reaction caused by polymer particles and hypersensitivity response. The selection of the density of drugs and the quality of polymer materials is necessary to control the dissolution of drugs (sustained-release). On the other hand, in the Co-based alloy in which the porous structure is formed on the surface layer, drugs can be directly applied onto the surface of the stent without coating supporting materials. Consequently, the increase in the amount of coating due to the porous layer and the sustained-release due to the shape of the surface can also be controlled.

In the application of artificial bone, when the body tissue enters the micropore, it is tightly binds to the porous surface layer region. As a result, the surface layer region becomes predominant in the Co-based alloy excellent in corrosion resistance, strength, and biocompatibility, and thus it is stably implanted in the living body in the extremely stable state. Additionally, regeneration of bones is facilitated. Further, when the porous surface layer region is modified with apatite, it is tightly bound to the body tissue.

Subsequently, the present invention will be described with reference to Examples while referring to the drawings.

Example 1

Co—Al binary alloys (Table 3) containing varying proportions of Al were dissolved and casted. In Test Nos. 7 to 9, each of the alloys formed cast structures during solidification and cooling process and left as they were. In Test Nos. 1 to 6 and 10, each alloy was cold-rolled to a plate thickness of 1 mm after hot rolling. Then, the cold-rolled plate was subjected to solution treatment at 1200° C. for 15 minutes, followed by aging heat-treatment at 600° C. for 12 hours and a lamellar structure was formed.

Each Co—Al alloy plate was observed with a microscope and the precipitation state of the β (B2)-phase was examined. Further, SEM image of each Co—Al alloy plate was subjected to image processing and then the volume ratio converted from an area ratio of the lamellar structure and interlayer spacing were determined.

SUJ-2 was used as a mating member and the wear volume was determined by using Ogoshi wear testing machine.

The wear resistance was evaluated based on the following criteria:

◎ (Excellent): specific wear volume, $1\times10^{-6}$ $mm^2$/kg or less;

○ (Good): specific wear volume, $(1.0 \text{ to } 5.0)\times10^{-6}$ $mm^2$/kg;

Δ (Poor): specific wear volume, $(5.0 \text{ to } 10)\times10^{-6}$ $mm^2$/kg; and X (Bad): specific wear volume, $10\times10^{-6}$ $mm^2$/kg or more.

As is apparent from the research results in Table 3, in the Co—Al alloys of Test Nos. 2 to 6 where the Al content was in the range of 3 to 15%, the lamellar structure in which the f.c.c. structure α-phase and β (B2)-phase were superimposed on each other was formed. As a result, as is apparent from FIG. 2 where the Co-based alloy of Test No. 5 was observed by SEM, a clear lamellar structure was formed.

In the Co—Al alloys of Test Nos. 7 and 8, the lamellar structure in which the f.c.c. structure α-phase and β (B2)-phase were repeated was formed by crystallization reaction in solidification process. The interlayer spacing of Test No. 8 where the cooling rate was slow was larger than that of Test No. 7.

On the other hand, in the alloy containing less than 3% of Al of Test No. 1, the precipitation of the β (B2)-phase was insufficient and the alloy was of substantially the same structure of α-single phase. On the contrary, in the case of Test Nos. 9 and 10 where the content of Al exceeds 15%, the matrix became the β (B2)-phase and the proportion of the lamellar structure was significantly reduced in either case of casting solidification or aging treatment.

The volume ratio converted from an area ratio of the lamellar structure and interlayer spacing which were determined in the image processing of SEM image were shown in Table 3.

The machinery strength and wear resistance of the Co—Al alloy was changed depending on how the lamellar structure was formed. The Co—Al alloy in which the lamellar structure was formed in the whole surface was excellent in wear resistance and highly strengthened. On the other hand, in the case of the Co—Al alloy in which the precipitation of the β (B2)-phase was insufficient, the tensile strength and proof strength were poor. In the case of the Co—Al alloy in which the matrix became the β (B2)-phase, the elongation at break was poor and the ductility was reduced.

The Co-based alloy having the lamellar structure (No. 5) was immersed in an acid solution ($FeCl_3$:HCl:$H_2O$=10 g:25 ml:100 ml), solution temperature: at 25° C. The stainless steel was a cathode and electrolytic polishing was performed by passing current from a direct current power source at a current density of 30 A/$dm^2$.

After the electrolytic polishing for 15 minutes, the Co-based alloy was picked up from the polishing solution and dried, followed by SEM observation of the surface of Co-based alloy. As is apparent from FIG. 2(*b*), a porous layer in which the trace of the β (B2) phase selectively dissolved had a micro cavity was formed on the surface of the Co-based alloy.

The porous surface layer region was measured on the basis of a magnified SEM image (FIG. 2*c*) and it was found that porous structure was formed to a depth of 28 μm below the surface of the Co-based alloy and a skeleton of the porous layer was formed in the α-phase remained after the electrolytic polishing. As for the Co-based alloy of Test Nos. 1 to 10 in Table 3, the depths of the porous layers which were determined based on the SEM image in the same manner as described above were shown in Table 4.

The formation of the porous layer is observed in the Co-based alloy having the lamellar structure after the electrolytic polishing, which is a typical phenomenon. In Test Nos. 1, 9, and 10 without the lamellar structure, such a distinct porous layer was not detected.

Subsequently, the surface area of the Co-based alloy with electrolytic polishing was calculated based on image analysis of the SEM image. Then, the ratio of the surface area of the Co-based alloy with electrolytic polishing to the surface area of the Co-based alloy without electrolytic polishing was calculated.

As is apparent from the research results in Table 4, it was found that when the Co-based alloy having the lamellar structure was subjected to electrolytic polishing, a porous structure

TABLE 3

Al content, Effects of production conditions on metallic structure and physical properties

| Test No. | Al-content (%) | Production conditions of lamellar structure | Metallic structure: Precipitation state | Metallic structure: Occupancy ratio of lamellar structure (vol. %) | Metallic structure: Interlayer spacing (nm) | 0.2% proof strength (MPa) | Tensile strength (MPa) | Elongation at break (%) | Wear resistance |
|---|---|---|---|---|---|---|---|---|---|
| 1 | 1.9 | Heat treatment | No precipitation | 0 | — | 141 | 315 | 11.2 | X |
| 2 | 3.8 | Heat treatment | Layered shape | 45 | 315 | 398 | 624 | 6.3 | ○ |
| 3 | 4.8 | Heat treatment | Layered shape | 74 | 277 | 718 | 1020 | 4.6 | ○ |
| 4 | 5.9 | Heat treatment | Layered shape | 98 | 248 | 805 | 1150 | 3.0 | ◎ |
| 5 | 6.9 | Heat treatment | Layered shape | 100 | 120 | 928 | 1221 | 2.1 | ◎ |
| 6 | 8.0 | Heat treatment | Layered shape + massive shape | 85 | 123 | 878 | 1087 | 1.4 | ◎ |
| 7 | 9.5 | Solidification cooling I | Layered shape | 100 | 2800 | 764 | 991 | 1.8 | ○ |
| 8 | 9.5 | Solidification cooling II | Layered shape | 100 | 12000 | 712 | 879 | 1.0 | ○ |
| 9 | 16.0 | Solidification cooling I | β-phase + massive α-phase | 0 | — | 660 | 660 | 0.2 | ○ |
| 10 | 16.0 | Heat treatment | β-phase + spicula α-phase | 0 | — | 667 | 711 | 0.4 | ○ |

Heat treatment: solution treatment (at 1200° C. for 15 minutes) → aging treatment (at 600° C. for 12 hours)

Solidification cooling I: cooling with an average cooling rate: 200° C./min in the range of 1500 to 600° C.

Solidification cooling II: cooling with an average cooling rate: 50° C./min in the range of 1500 to 600° C.

was formed on the surface layer region and a micropore was given, thereby significantly increasing the surface area. On the other hand, the porous structure was not formed on the surface layer of the Co-based alloy without lamellar structure after the electrolytic polishing.

TABLE 4

| Porous surface layer region formed after electrolytic polishing | | | |
|---|---|---|---|
| Test No. | Depth (μm) | Void volume (%) | Surface area ratio |
| 1 | 0 | 0 | 1.0 |
| 2 | 10 | 12 | 8.1 |
| 3 | 19 | 16 | 29.3 |
| 4 | 28 | 25 | 41.0 |
| 5 | 28 | 36 | 43.9 |
| 6 | 22 | 15 | 30.1 |
| 7 | 3 | 20 | 4.0 |
| 8 | 5 | 20 | 2.4 |
| 9 | 0 | 0 | 1.0 |
| 10 | 0.1 | <1 | 1.1 |

Example 2

Taking the Co—Al alloy of Test No. 5 in Example 1 where a porous layer with a large surface area ratio was formed as an example, effects of temperature conditions in the solution treatment and aging treatment on the precipitation of layered β (B2) phase and the form of porous layer were examined. In the formation of the porous layer, the same electrolytic polishing as described in Example 1 was used.

As is apparent from the research results in Table 5, the precipitation of the β(B2)-phase was facilitated in conditions of a solution treatment temperature in the range of 900 to 1400° C. and an aging temperature in the range of 500 to 900° C. After the electrolytic polishing, a porous layer with a surface area ratio of 5.9 or more was formed on the surface layer region of a depth of 5 μm upper the surface of the Co-based alloy.

In the case of the aging temperature less than 500° C., the formation and the growth of the β (B2)-phase were insufficient and the lamellar structure was not formed. Therefore, the surface of the Co-based alloy did not have the porous structure after the electrolytic polishing. In the case of the aging temperature greater than 900° C., the β (B2)-phase was not precipitated in layers and the porous layer was formed on the surface layer region of a depth of 100 nm below the surface of the Co-based alloy after the electrolytic polishing and its surface area ratio was 1.2. It was an insufficient porous structure to impart necessary functions. Further, when the solution treatment temperature did not reach 900° C., precipitates were not sufficiently dissolved and the aging treatment was carried out. As a result, the formation of lamellar structure was inhibited by a residue of the precipitates. The surface of the Co-based alloy after the electrolytic polishing did not have the porous structure and was rough-surfaced. On the other hand, in the case where the solution treatment was performed at high temperatures greater than 1400° C., massive precipitates derived from a liquid phase formed by partial melting were produced and the surface condition was not suitable to form the porous structure.

TABLE 5

| Effects of heat treatment conditions on metallic structure of Co-alloy containing 6.9% of Al and form of porous layer region produced by electrolytic polishing | | | | | | | | | | |
|---|---|---|---|---|---|---|---|---|---|---|
| | Solution treatment (min) | | Aging treatment | | Metallic structure | | | Form of porous surface layer region | | |
| Test No. | (° C.) | (min) | (° C.) | (hr) | Form of precipitation | Occupancy ratio of lamellar structure (volume %) | Interlayer spacing (nm) | Depth (μm) | Void volume (%) | Surface area ratio |
| 11 | 800 | 120 | 600 | 12 | Bar shape + layered shape | 15 | 275 | 0.1 | 1 | 1.2 |
| 12 | 950 | 120 | 600 | 12 | Layered shape + bar shape | 74 | 155 | 9 | 21 | 10.5 |
| 13 | 1200 | 15 | 400 | 48 | No precipitation | 0 | — | — | — | 1.0 |
| 14 | 1200 | 15 | 500 | 48 | Layered shape | 65 | 71 | 26 | 39 | 21.1 |
| 15 | 1200 | 15 | 600 | 12 | Layered shape | 100 | 120 | 28 | 36 | 43.9 |
| 16 | 1200 | 15 | 900 | 6 | Layered shape + bar shape | 33 | 215 | 5 | 16 | 5.9 |
| 17 | 1200 | 15 | 1000 | 12 | Bar shape | 0 | — | 0.1 | 1 | 1.2 |
| 18 | 1350 | 15 | 600 | 12 | Layered shape | 100 | 132 | 30 | 35 | 42.9 |
| 19 | 1440 | 15 | 600 | 12 | Massive shape + layered shape | 5 | 255 | 0.2 | 1 | 1.0 |

Example 3

The Co-aluminum alloy containing 6.9% of Al was subjected to solution treatment at 1200° C. for 15 minutes and aging treatment at 600° C. for 12 hours to form a lamellar structure. The β (B2)-phase was selectively removed from the surface of Co-based alloy by electrolytic polishing or chemical polishing.

In the electrolytic polishing, Electrolytic polishing I using an electrolytic solution ($H_20$:$H_3P0_4$=3 ml:2 ml), Electrolytic polishing II using an electrolytic solution ($FeCl_3$:HCl:

$H_2O$=10 g:5 ml:100 m1, and Electrolytic polishing III using an electrolytic solution ($FeCl_3$:HCl:$H_2O$=10 g:25 ml:100 ml) were used. In any electrolytic polishing, the stainless steel was used as a cathode. The solution temperature, the current density, and the immersion time were set to 25° C., 30 A/dm$^2$, and 15 minutes, respectively.

In the chemical polishing, Chemical polishing I using an acid solution (HCl:$HNO_3$=3 ml:1 ml), Chemical polishing II using an acid solution (HCl:$H_2O$=1 ml:4 ml), Chemical polishing III using an acid solution ($FeCl_3$:HCl:$H_2O$=10 g:25 ml:100 ml), and Chemical polishing IV using an acid solution (EtOH:$HNO_3$=100 ml:20 ml). In any chemical polishing, the solution temperature was set to 25° C. and the immersion time was set to 30 minutes.

As for the Co-based alloy after polishing, the form and characteristics of the porous layers were examined in the same manner as described in Example 1. As is apparent from the research results in Table 6, it was found that the porous layers having the same characteristics were formed regardless of the polishing method. The surface area ratio was increased with increasing depth of the porous layer and the surface area ratio was 1.5 or more in any case. In the case where the porous surface layer region was formed by selectively removing the β-phase, a porous skeleton was formed in the α-phase remained, and thus the porous layer region was soft and rich in ductility with a small pore size. The depth of the porous layer tended to be larger.

TABLE 6

Form of porous layer depending on polishing means (Case of selectively removing β-phase)

| Test No. | Polishing method | | Form of the porous surface layer region: Depth (μm) | Void volume (%) | Surface area ratio |
|---|---|---|---|---|---|
| 20 | Electrolytic polishing | I | 1 | 30 | 2.1 |
| 21 | Electrolytic polishing | II | 5 | 34 | 10.1 |
| 22 | Electrolytic polishing | III | 28 | 36 | 43.9 |
| 23 | Chemical polishing | I | 4 | 36 | 8.5 |
| 24 | Chemical polishing | II | 1.5 | 33 | 4.0 |
| 25 | Chemical polishing | III | 0.8 | 31 | 2.2 |
| 26 | Chemical polishing | IV | 0.6 | 31 | 1.7 |

Example 4

The Co—Al alloy containing 6.9% of Al having the lamellar structure was physically polished by the same aging treatment as described in Example 3 and the α-phase was selectively removed from the surface layer of the Co-based alloy.

In Physical polishing I, ion milling was performed using argon gas at 30 μA for 4 hours.

In Physical polishing II, focused ion beam irradiation was carried out at 30 kV, 10 nA using gallium ion beams.

In Physical polishing III, air blast was performed using an alumina polishing material with a particle diameter of 1.2 μm.

As for the Co-based alloy after polishing, the form and characteristics of the porous layers were examined in the same manner as described in Example 1. As is apparent from the research results in Table 7, it was found that the porous layers having the same characteristics were formed regardless of the polishing method. The surface area ratio was increased with increasing depth of the porous layer and the surface area ratio was 1.5 or more in any case. In the example, the skeleton of the porous structure was formed in a relatively hard β-phase, and thus the obtained porous layer region tended to be hard with a high strength and a large pore size. The depth of the porous layer tended to be smaller.

TABLE 7

Form of porous layer depending on polishing means (Case of selectively removing α-phase)

| Test No. | Polishing method | | Form of the porous surface layer region: Depth (μm) | Void volume (%) | Surface area ratio |
|---|---|---|---|---|---|
| 27 | Physical polishing | I | 0.6 | 36 | 1.6 |
| 28 | Physical polishing | II | 0.5 | 30 | 1.5 |
| 29 | Physical polishing | III | 0.7 | 38 | 1.8 |

Example 5

The effects of the third component to be added to the Co—Al alloy on the mechanical property, the lamellar structure, and further the formation and physical properties of the porous surface layer region were examined. The Co-based alloys of Tables 8 and 9 were subjected to solution treatment at 1200° C. for 15 minutes, followed by performing aging treatment at 600° C. for 24 hours and the lamellar structure was formed. The α-phase and the precipitated phase were selectively removed by anodic electrolysis at 30 A/dm$^2$ using an electrolytic solution ($FeCl_3$:HCl:$H_2O$=10 g:25 ml:100 ml) and the porous surface layer region was formed.

In the corrosion test, the passive current density at 0 V vs. SCE was determined by the anode polarization test using PBS (−) solution (25° C.).

The corrosion resistance was evaluated based on the following criteria:

◎ (Excellent): passive current density, 0.05 A/m$^2$ or less;

○ (Good): passive current density, 0.05 to 0.1 A/m$^2$;

Δ (Poor): passive current density, 0.1 to 0.3 A/m$^2$; and

X (Bad): passive current density, 0.3 A/m$^2$ or more.

As is apparent from the research results in Tables 8 and 9, the lamellar structure and porous surface layer region were formed, and the surface area ratio was increased in any test. Particularly, it was confirmed that the addition of a proper amount of the third component specified by the present invention allows the ductility and the corrosion resistance to be improved.

TABLE 8

Effects of the addition of third component on lamellar structure, porous surface layer region, and corrosion resistance (Solution treatment: at 1200 C. ° for 15 min: aging treatment: at 600 C. ° for 24 hr)

| Test | Alloy composition (mass %, balance being Co) | | Lamellar structure | | | | Form of porous surface layer region | | | Corrosion |
|---|---|---|---|---|---|---|---|---|---|---|
| No. | Al | Third component | Precipitated phase | Form of precipitation | Occupancy ratio (vol. %) | Interlayer spacing (nm) | Depth (μm) | Void volume (%) | Surface area ratio | resistance |
| 30 | 6.9 | Ni: 21.6 | B2 | Layered shape | 100 | 288 | 19 | 24 | 22.4 | ○ |
| 31 | 6.0 | Ni: 19.7, Cr: 19.4 | B2 | Layered shape | 65 | 349 | 10 | 24 | 7.4 | ◎ |
| 32 | 4.9 | Fe: 10.1 | B2 | Layered shape | 100 | 235 | 23 | 31 | 30.6 | ○ |
| 33 | 4.9 | Mn: 20.0 | B2 | Layered shape | 100 | 243 | 29 | 35 | 37.8 | ○ |
| 34 | 5.0 | Cr: 19.1 | B2 | Layered shape | 46 | 297 | 13 | 12 | 9.3 | ◎ |
| 35 | 5.0 | Fe: 10.3, Cr: 19.2 | B2 | Layered shape | 100 | 136 | 17 | 29 | 30.3 | ◎ |
| 36 | 5.4 | Mo: 19.3 | B2, $D0_{19}$ | Layered shape | 77 | 166 | 15 | 15 | 30.5 | ◎ |
| 37 | 3.6 | W: 24.6 | $D0_{19}$, $L1_2$ | Layered shape + plate shape | 97 | 145 | 19 | 18 | 16.1 | ○ |
| 38 | 4.8 | Zr: 1.6 | B2 | Layered shape | 70 | 261 | 15 | 14 | 22.4 | ○ |
| 39 | 4.6 | Ta: 6.2 | B2 | Layered shape | 90 | 300 | 12 | 17 | 17.2 | ○ |
| 40 | 4.7 | Hf: 3.1 | B2 | Layered shape | 69 | 216 | 16 | 13 | 25.6 | ○ |
| 41 | 4.8 | Ga: 6.2 | B2 | Layered shape | 100 | 168 | 21 | 23 | 30.2 | ○ |

TABLE 9

Effects of the addition of third component on lamellar structure, porous surface layer region, and corrosion resistance (Solution treatment: at 1200 C. ° for 15 min: aging treatment: at 600 C. ° for 24 hr)

| Test | Alloy composition (mass %, balance being Co) | | Lamellar structure | | | | Form of porous surface layer region | | | Corrosion |
|---|---|---|---|---|---|---|---|---|---|---|
| No. | Al | Third component | Precipitated phase | Form of precipitation | Occupancy ratio (vol. %) | Interlayer spacing (nm) | Depth (μm) | Void volume (%) | Surface area ratio | resistance |
| 42 | 4.9 | V: 9.3 | B2 | Layered shape | 71 | 276 | 12 | 10 | 12.1 | ○ |
| 43 | 3.8 | Ti: 7.5 | B2, $L1_2$ | Layered shape + plate shape | 95 | 313 | 6 | 33 | 4.9 | ○ |
| 44 | 4.7 | Nb: 8.1 | B2 | Layered shape | 84 | 248 | 19 | 20 | 21.0 | ○ |
| 45 | 4.7 | Ni: 20.5, Mo: 8.4, C: 0.1 | B2, $M_{23}C_6$ | Layered shape + plate shape | 49 | 181 | 3 | 10 | 2.7 | ○ |
| 46 | 7.2 | Fe: 10.6, C: 0.7 | B2, $E2_1$ | Layered shape + plate shape | 44 | 180 | 4 | 9 | 2.2 | ○ |
| 47 | 4.7 | Rh: 5.4 | B2 | Layered shape | 49 | 316 | 4 | 10 | 3.1 | ◎ |
| 48 | 4.7 | Pd: 5.6 | B2 | Layered shape | 62 | 304 | 5 | 11 | 3.9 | ◎ |
| 49 | 4.5 | Ir: 9.7 | B2 | Layered shape | 45 | 403 | 2 | 6 | 2.7 | ◎ |
| 50 | 4.3 | Pt: 15.6 | B2 | Layered shape | 60 | 319 | 4 | 10 | 5.6 | ◎ |
| 51 | 4.5 | Au: 9.9 | B2 | Layered shape | 60 | 295 | 6 | 11 | 7.1 | ◎ |
| 52 | 7.0 | Ni: 21.6, B: 0.04 | B2 | Layered shape | 100 | 268 | 17 | 21 | 22.9 | ○ |
| 53 | 6.9 | P: 0.02 | B2 | Layered shape | 74 | 255 | 18 | 16 | 30.1 | ○ |

Industrial Applicability

As described above, the porous structure is formed by selectively removing the α-phase or β (B2)-phase from the surface layer region of the Co—Al alloy having the lamellar structure, thereby imparting functions such as retention of substance, sustained-release, strong coupling, biocompatibility, heat dissipation, and catalytic activity. In addition, the Co-based alloy is applied to medical instruments such as a drug-eluting stent and a catheter; biomaterials such as artificial bones and dental implants; catalyst carriers; selective adsorbent beds; heat sinks; and bearings since an excellent corrosion resistance of the Co-based alloy in itself, high strength resulting from the lamellar structure, and wear resistance are utilized.

The invention claimed is:

1. A functional member from a Co-based alloy comprising:

a base member of a Co—Al alloy containing 3 to 15% by mass of Al; and a lamellar structure wherein the occupancy ratio is 30% by volume or more, a f.c.c. structure α-phase and β(B2)-phase with an interlayer spacing of 100 μm or less are repeated in layers, and the surface of the base member is modified so as to have a porous surface layer region through selective removal of the α-phase or the β(B2)-phase.

2. The functional member from a Co-based alloy according to claim 1, further comprising a base member of a Co-based alloy having a composition which comprises, on the basis of mass percent, 3 to 15% of Al and further comprises one or more members selected from the following: 0.01 to 50% of Ni, 0.01 to 40% of Fe, 0.01 to 30% of Mn, 0.01 to 40% of Cr, 0.01 to 30% of Mo, 0.01 to 5% of Si, 0.01 to 30% of W, 0.01 to 10% of Zr, 0.01 to 15% of Ta, 0.01 to 10% of Hf, 0.01 to 20% of Ga, 0.01 to 20% of V, 0.01 to 12% of Ti, 0.01 to 20% of Nb, 0.001 to 3% of C, 0.01 to 20% of Rh, 0.01 to 20% of Pd, 0.01 to 20% of Ir, 0.01 to 20% of Pt, 0.01 to 10% of Au, 0.001 to 1% of B, and 0.001 to 1% of P in a total of 0.001 to 60% and with inevitable impurities.

3. The functional member from a Co-based alloy according to claim 1, wherein the porous surface layer region has a depth of 500 nm or more below the surface of the base member and the area of the porous surface layer region is 1.5 times more than that of the surface area before porous formation.

* * * * *